United States Patent [19]

Costa et al.

[11] Patent Number: 5,001,401

[45] Date of Patent: Mar. 19, 1991

[54] DUAL VOLTAGE BALLAST

[75] Inventors: Larry J. Costa; Dail L. Swanson, both of Danville, Ill.

[73] Assignee: Valmont Industries, Inc., Valley, Nebr.

[21] Appl. No.: 335,387

[22] Filed: Apr. 10, 1989

[51] Int. Cl.[5] ..... H05B 41/16

[52] U.S. Cl. ..... 315/278; 315/276; 336/170; 336/90

[58] Field of Search ..... 315/276, 277, 278, 354, 315/70, 282, 279; 336/170, 171, 90, 96, 69, 70; 174/DIG. 2

[56] References Cited

U.S. PATENT DOCUMENTS 4,916,363 4/1990 Burton et al. ..... 315/276

*Primary Examiner*—Eugene R. LaRoche
*Assistant Examiner*—Ali Neyzari
*Attorney, Agent, or Firm*—Zarley, McKee, Thomte, Voorhees & Sease

[57] ABSTRACT

In one form of the multiple voltage ballast system described herein, each of the primary coils has different wire sizes with the largest diameter wire being utilized in the 120 V primary coil. In another form of the invention, a pair of 120 V primary coils are connected in series with a 37 V primary coil so that the ballast may function as a 277 V ballast. The primary coils are also electrically connected so that the ballast may be used as a 120 V ballast.

6 Claims, 2 Drawing Sheets

DUAL VOLTAGE BALLAST

BACKGROUND OF THE INVENTION

This invention relates to a ballast for fluorescent lights or the like and more particularly to a dual voltage ballast which may be used either as a 277V ballast or as a 120V ballast.

There are some ballasts that are manufactured which have a 120V rating and there are other ballasts which have a 277V rating since the major voltage systems for fluorescent lights utilize either a 120V or 277V distribution potential. However, there are some ballasts that are termed multiple tap ballasts that have 120V, 208V, 240V and 277V distribution potentials depending upon the particular tap that is utilized.

In all of the multiple-rated voltage ballasts, the primary coil wire size is dictated by the larger current flowing in the primary coil when the 120V tap connection is utilized. The same wire is used for the total coil winding thereby creating an inefficient utilization of material.

It is therefore a principal object of the invention to provide an improved dual voltage ballast.

A further object of the invention is to provide a multiple voltage ballast wherein the windings of the primary coils thereof have different wire sizes.

Still another object of the invention is to provide a dual ballast which is ideally suited for use with a leadless ballast so that the ballast can be used either as a 120V ballast or as a 277V ballast.

Still another object of the invention is to provide a dual voltage ballast which reduces the amount of inventory normally required by a manufacturer.

Still another object of the invention is to provide a dual voltage ballast which is economical of manufacture and durable in use.

These and other objects will be apparent to those skilled in the art.

SUMMARY OF THE INVENTION

In one form of the multiple voltage ballast system of this invention, each of the primary coils has different wire sizes with the largest diameter wire being utilized in the 120V primary coil. In another form of the invention, a pair of 120V primary coils are connected in series with a 37V primary coil so that in the normal situation, the ballast will function as a 277V ballast. The primary coils are also electrically connected so that when the ballast is to be used as a 120V ballast, the two 120V primary coils are wired in parallel with the 37V coil not being utilized. The leadless ballast of co-pending application Ser. No. 257,528 filed Oct. 14, 1988 entitled "An Improved Ballast" is ideally suited for use with the dual voltage ballast of this invention in that appropriate connectors and wiring harnesses may be utilized with the circuit to either connect the primary coils in series to achieve the 277V potential or connect the 120V coils in parallel to provide a 120V ballast.

DESCRIPTION OF THE PREFERRED EMBODIMENT

Figure 1:
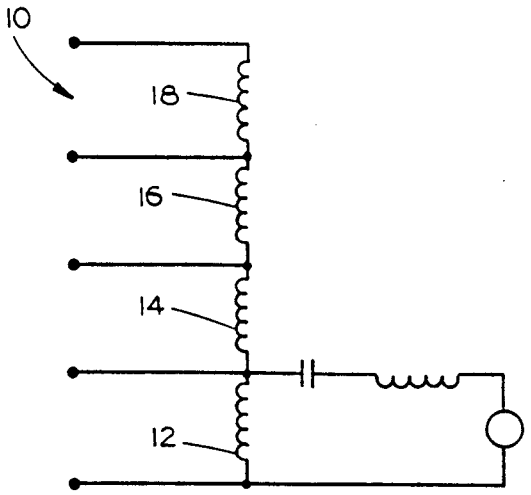
FIG. 1 (PRIOR ART)
FIG. 1 is an electrical schematic illustrating one type of prior art ballast.

FIG. 1 illustrates the electrical circuitry of a prior art multiple tap ballast 10 for a fluorescent light which can be used in 120V, 208V, 240V or 277V voltage systems. In FIG. 1, the primary coil wire size in the primary coils 12, 14, 16 and 18 is dictated by the larger current flowing in the primary coil 12 when the 120V tap connection is utilized. Thus, the same large wire size is used in all of the primary coils 12, 14, 16 and 18 thereby creating an inefficient utilization of material.

Figure 2:
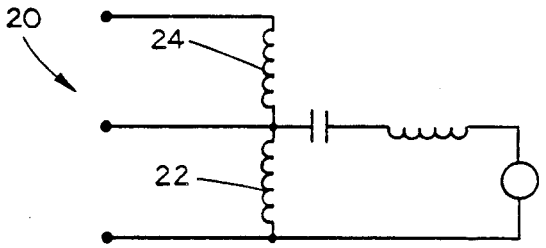
FIG. 2 (PRIOR ART)
FIG. 2 is an electrical schematic illustrating a second form of a prior art ballast.

In FIG. 2, a prior art dual voltage ballast 20 is illustrated which has primary coils 22 and 24. Inasmuch as the wire size in the primary coils 22 and 24 is also dictated by the larger current flowing in the primary coil 22 when the 120V tap is utilized, as discussed hereinabove with respect to the ballast of FIG. 1, an inefficient utilization of material also results in the ballast of FIG. 2.

In the past, a ballast manufacturer has been faced with two choices. The manufacturer can either build the ballasts of FIG. 1 and 2 with the higher attendant costs of inefficient material utilization or the manufacturer can separately inventory 120V and 277V ballasts.

The leadless ballast described in co-pending application Ser. No. 257,528 now makes it possible to provide a dual ballast thereby permitting a vast reduction of inventory and also permitting the ballasts to be manufactured at a lower cost.

Utilizing the leadless ballast, the following approaches are viable:

EXAMPLE I

If using four wire sizes for the ballast 10 illustrated in FIG. 1, coil 12 uses 0.0580" O.D. wire,
coil 14 uses 0.0380" O.D. wire,
coil 16 uses 0.0259" O.D. wire, and
coil 18 uses 0.0190" O.D. wire.

EXAMPLE II

If using two wire sizes for the ballast 20 illustrated in FIG. 2, coil 22 uses 0.0580" O.D. wire and
coil 24 uses 0.0380" O.D. wire.

EXAMPLE III

Figure 5:
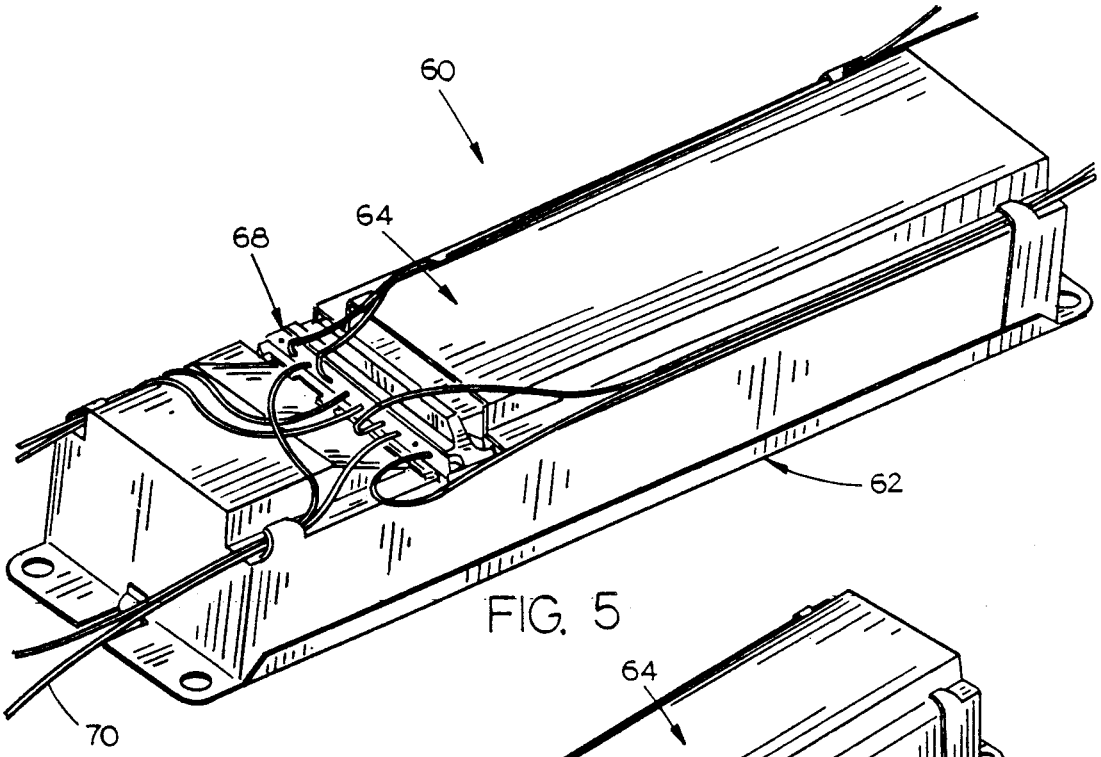
FIG. 5 is an exploded perspective view of a portion of the leadless ballast of the co-pending application which will be identified hereinbelow.
Figure 6:
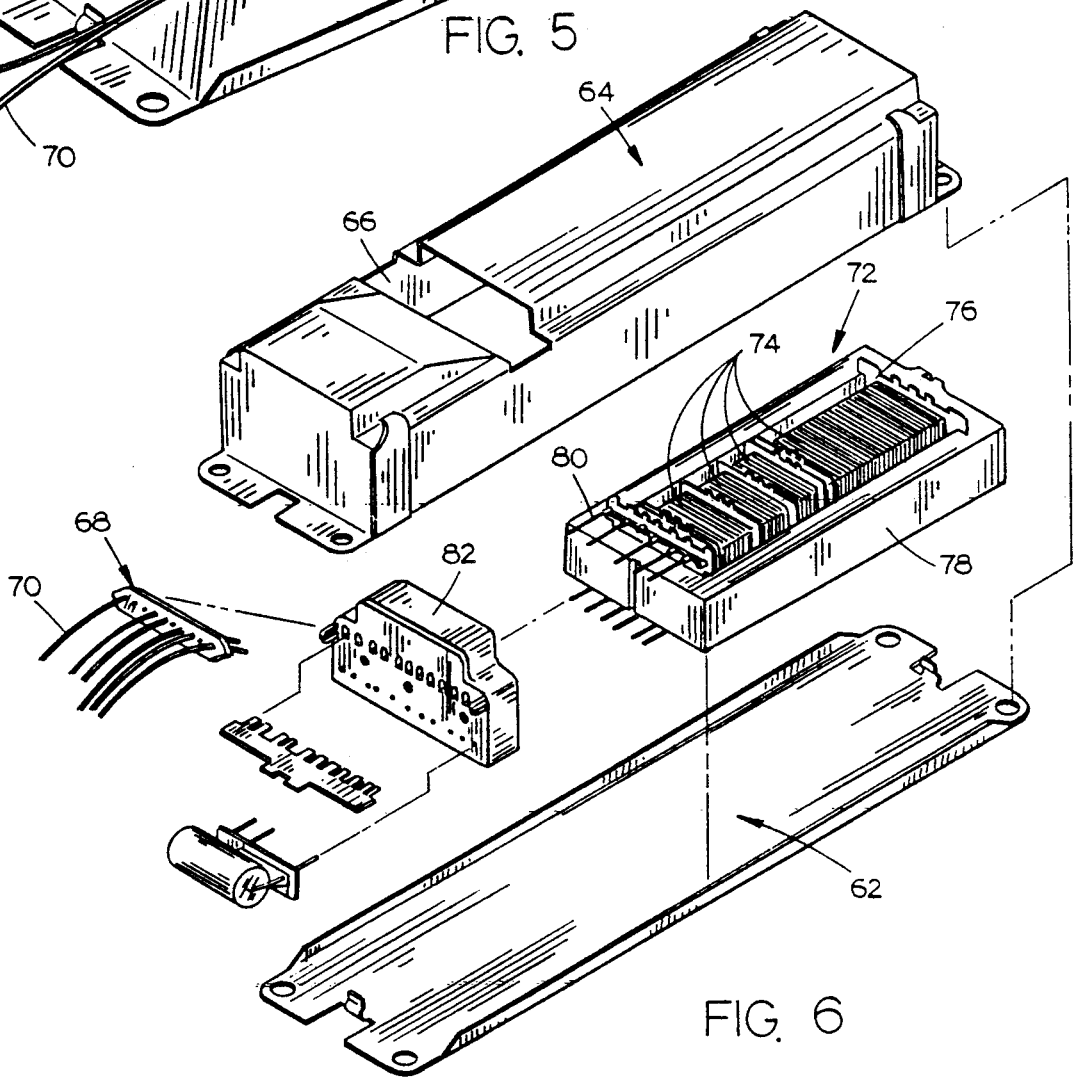
FIG. 6 is an exploded perspective view of the leadless ballast of the co-pending application.

In FIG. 5, the leadless ballast of the co-pending application Ser. No. 257,528 is disclosed. As seen, the ballast 60 includes a flat base or case portion 62 and a case or cover 64. Cover 64 is provided with an access opening 66 formed therein to facilitate the angular insertion of one end of the wiring harness 68 having leads 70 associated therewith. Coil-core assembly 72 is positioned within case portion 62 and has a plurality of coils 74 wound on a bobbin 76 positioned within core 78. Terminal pins 80 extend from the bobbin and are electrically connected to the appropriate coils in the appropriate fashion.

Figure 3:
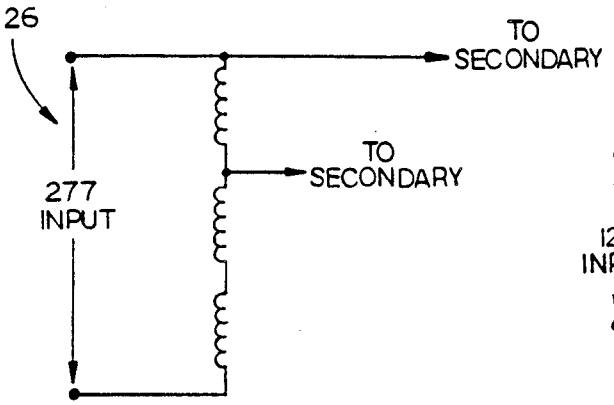
FIG. 3 is an electrical schematic of the dual voltage ballast of this invention.
Figure 4:
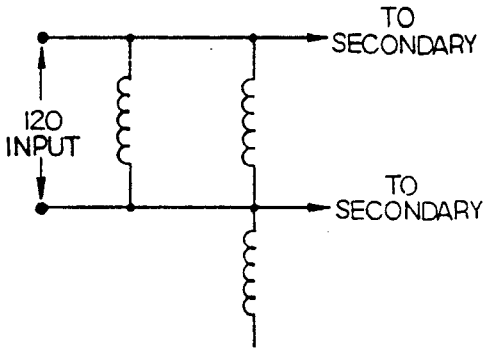
FIG. 4 is an electrical schematic of the dual voltage ballast of this invention when the ballast is being used as a 120V ballast.

An alternative to Examples I and II is illustrated in FIGS. 3 and 4. Ballast 26 is designed for 120V operation since the ballast is somewhat less material efficient due to not using a 37V winding. Therefore, coils 1 and 2 are designed for 120V operation and coil 3 is designed to meet the 277V requirements. Coil 3 may be the same wire size, or smaller than coils 1 and 2 which preferably have identical wire sizes.

The coils 1, 2 and 3 are also provided with the necessary leads or electrical connections so that the coils 1 and 2 are selectively connected in parallel as seen in FIG. 4 when the ballast 26 is to be used as a 120V ballast. To maximize the efficiency of the corresponding re-connected 120V unit, the second coil 2 is necessary to achieve the same required ampere-turn magnetizing force.

Thus, in addition to the wiring illustrated in FIG. 3 which is connected to the terminal pins 80, the coils 1 and 2 would also be electrically connected to terminal pins so that they will be connected in parallel when an appropriate 120V connector 87 and 120V wiring harness are utilized to provide a 120V input to the unit.

In the 277V ballast of FIG. 3, the primary coils will be electrically connected to the terminal pins 80 in such a fashion so that when the appropriate connector 82 is connected thereto and the proper wiring harness 68 inserted into the connector 82, the ballast circuitry will be that as seen in FIG. 3. The coils are also connected to certain of the terminal pins 80 so that when the proper 120V connector 82 and the proper 120V wiring harness are utilized, the ballast circuitry will function as depicted in FIG. 4.

We claim:

1. A multiple tap ballast, comprising, a plurality of series connected primary coil windings having taps operatively associated therewith so that the ballast may be selectively utilized with various voltages, at least some of said coil windings having different wire diameters;

said primary coil windings comprising, a 120V coil winding, a 88V coil winding a 32V coil winding, and a 37V coil winding, said 120V coil winding having a greater wire diameter than said 37V coil winding.

2. A multiple tap ballast, comprising, a plurality of series connected primary coil windings having taps operatively associated therewith so that the ballast may be selectively utilized with various voltages, at least some of said coil windings having different wire diameters;

said primary coil windings comprising, a 120V coil winding, a 88V coil winding, a 32V coil winding, and a 37V coil winding, said 120V coil winding having a greater wire diameter than said 88V coil winding, said 88V coil winding having a greater wire diameter than said 32V coil winding, said 32V coil winding having a greater wire diameter than said 37V coil winding.

3. A multiple tap ballast, comprising a plurality of series connected primary coil windings having taps operatively associated therewith so that the ballast may be selectively utilized with various voltages, at least some of said coil windings having different wire diameters;

said primary coil winding comprising, a 120V coil winding and a 157V coil winding, said 120V coil winding having a greater wire diameter than said 157V coil winding.

4. A dual voltage ballast for a fluorescent light or the like comprising, a first 120V primary coil winding, a second 120V primary coil winding, a third 37V primary coil winding, first electrical circuit means series connecting said first, second and third primary coil windings to a source of 277V input so that a ballast designed for 277V is provided, second electrical circuit means connecting said first and second primary coil windings in parallel and disconnecting said 37V primary coil winding from the circuit, and connector means for operative electrical connection with either of said first or second electrical circuit means so that either a 120V input or a 277V input may be supplied to the ballast.

5. The ballast of claim 4 wherein said ballast is a leadless ballast housed in a case and wherein said connector means comprises a first connector element which is positioned in said case and a second connector element which may be removably electrically connected to said first connector element, said second connector element being electrically connected to a 120V or 277V power source.

6. The dual ballast of claim 6 wherein said first and second connector elements have cooperating electrical terminals which selectively provide either 120V or 277V power to the ballast.

* * * * *